US006526614B2

(12) United States Patent
Anderson et al.

(10) Patent No.: US 6,526,614 B2
(45) Date of Patent: Mar. 4, 2003

(54) PORTABLE AND LIGHTWEIGHT RAMP STRUCTURE

(75) Inventors: Theodore R. Anderson, Galway, NY (US); James R. Donahue, Falmouth, MA (US); William L. McCollum, West Warwick, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/832,156

(22) Filed: Apr. 9, 2001

(65) Prior Publication Data

US 2002/0144364 A1 Oct. 10, 2002

(51) Int. Cl.[7] ..... E01D 1/00
(52) U.S. Cl. ..... 14/69.5
(58) Field of Search ..... 404/34, 35, 36; 14/69.5

(56) References Cited

U.S. PATENT DOCUMENTS 3,984,891 A * 10/1976 Weinmann ..... 14/69.5
4,727,612 A * 3/1988 Smith ..... 14/69.5
4,807,317 A * 2/1989 Quinn et al. ..... 14/69.5
5,214,817 A * 6/1993 Allen ..... 14/69.5
5,341,533 A * 8/1994 Seitz ..... 14/69.5
5,446,937 A * 9/1995 Haskins ..... 14/69.5
5,713,165 A * 2/1998 Erwin ..... 52/181

* cited by examiner

*Primary Examiner*—Thomas B. Will
*Assistant Examiner*—Raymond W Addie
(74) *Attorney, Agent, or Firm*—James M. Kasischke; Michael J. McGowan; Michael F. Oglo

(57) ABSTRACT

A modular, portable and lightweight ramp of interlocking panels is used to provide a sloping surface between surfaces of differing heights. A first panel has a proximate end and a distal end and at its proximate end there is a tongue for connecting this first panel to a groove on an end cap, which rests on the higher surface. A second panel has a proximate and distal end and at its proximate end there is a tongue for connecting the second panel to a groove on the distal end of the first panel. One or more additional panels may be included in the ramp. The most distal panel rests on the base surface at its distal end. A distal end cap has a tongue that connects with a groove in the distal end of the most distal panel to provide a transition from the ramp to the base surface.

5 Claims, 8 Drawing Sheets

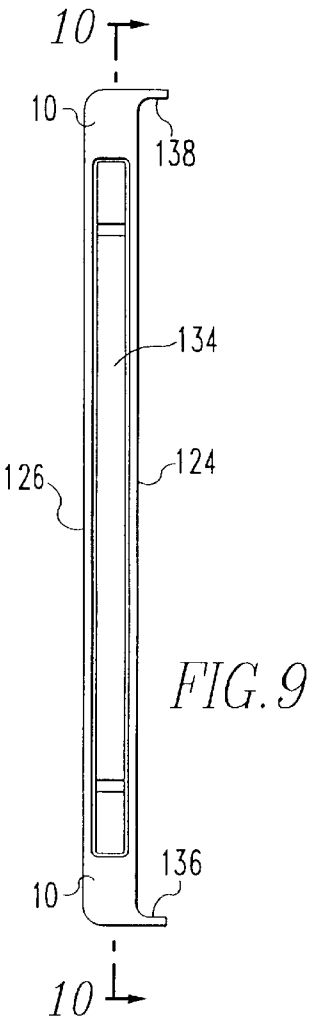
FIG. 9
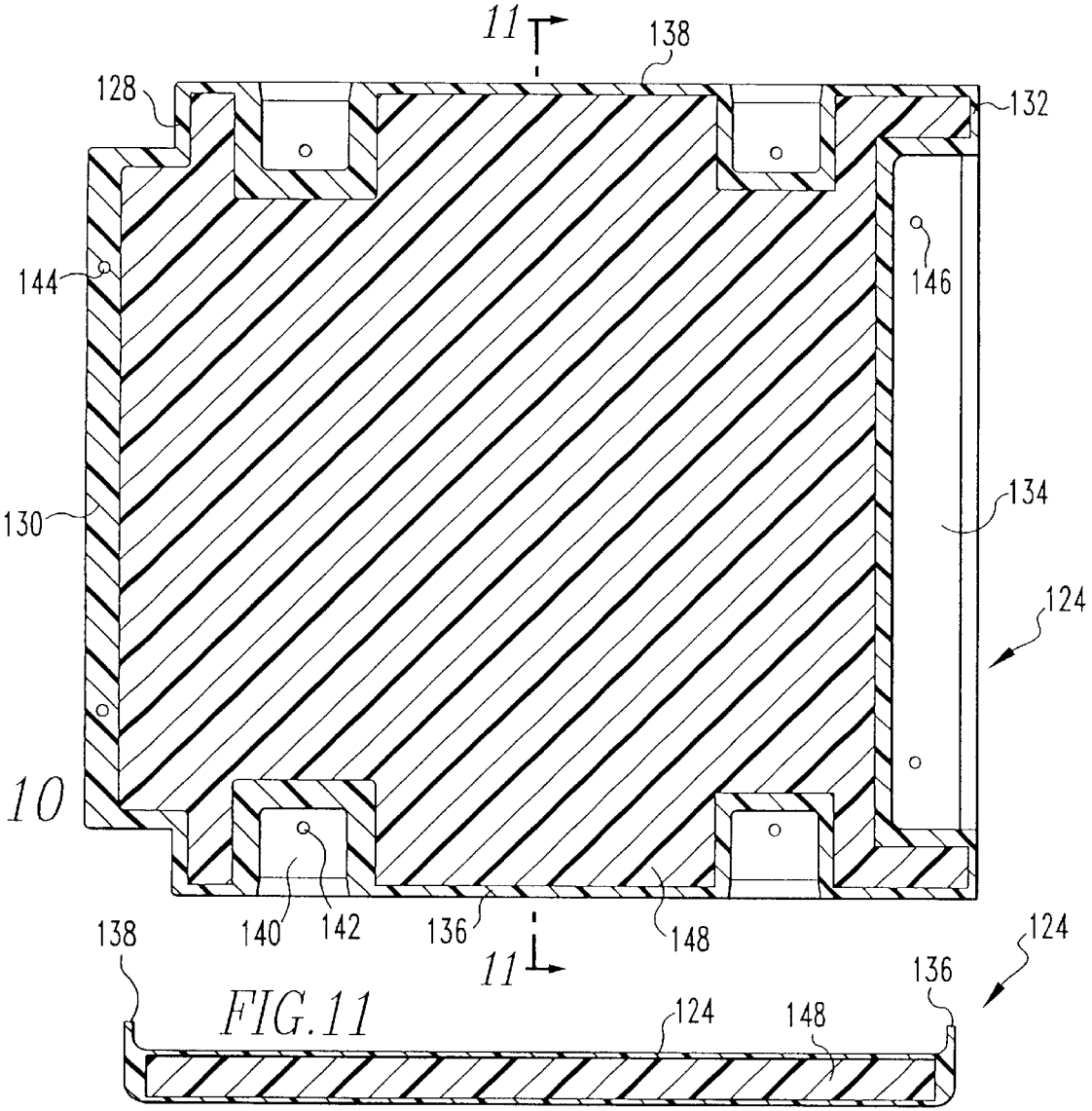
FIG. 10
FIG. 11

PORTABLE AND LIGHTWEIGHT RAMP STRUCTURE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to bridges and related structures and more particularly to gangways, ramps and dock levelers. Still more particularly this invention relates to portable, lightweight and modular ramps.

(2) Brief Description of the Prior Art

To address the needs of human access (such as for handicapped people) or general physical access, building owners have been required to construct accessibility structures for their buildings. These structures typically are fixed and made of concrete, steel or wood decking and hand metal rails. The installation of these structures, as required by law or building codes, can be expensive and at times geometrically impossible, as in the case of some historical buildings, which are unalterable by historical preservation laws or standards.

The prior art discloses various ramps and similar structures, which include features that are intended to facilitate their rapid and relatively inexpensive construction.

U.S. Pat. No. 3,301,149 to Box, for example, discloses a portable deck in which each mat has tongues and grooves for mating with adjacent mats. Holes in these tongues align with holes in the grooves. A pin passes through aligned holes to hold the mats together.

U.S. Pat. No. 3,546,773 to Gerstin discloses a modular structure made of polymer foam blocks held together with cables passing therethrough.

U.S. Pat. No. 4,807,317 to Quinn et al. discloses a modular and reusable wheelchair ramp capable of ready assembly and disassembly while providing a strong and safe construction. The ramp includes a plurality of leg assemblies fabricated of PVC plumbing components and a plurality of ramp sections each extending between and mounted on a pair of adjacent leg assemblies. Each leg assembly includes a pair of legs and an interconnecting crossbar slidably received thereon for ready height adjustability. The ramp sections are hooked over the crossbars. Handrails also fabricated of PVC plumbing components are also slidably mounted on the legs.

U.S. Pat. No. 5,214,817 to Allen discloses a modular ramp and landing assembly made from a plurality of similarly sized pre-manufactured concrete filled rectangular panels. The ramp portion is made from the modular panels attached by their shorter sides. A support post with an angularly arranged bracket is placed beneath the corners of adjacent panels to secure them together as well as support them. The landing or horizontal portion of this assembly comprises a similarly sized rectangular panel the long side of which is in abutting relationship with the short side of the end of the ramp. Fastener receivers are equi-spaced in duplicate patterns from each corner through the bottom edge of each panel. The size of the panels and the spacing of the fastener receivers are such that minimum support legs and brackets may be utilized in constructing this assembly at a final site.

U.S. Pat. No. 5,341,533 to Seitz discloses a modular ramp that comprises multiple sections that, except for height, have a similar cross-section and length along the ramp. Each modular section has a groove on one edge and a lip on the opposed edge that engage mating features of the preceding and following sections. The modular sections are conveniently prefabricated and provided in kit form to the number of sections corresponding to the desired ramp height.

U.S. Pat. No. 5,457,837 to Zuckerbrod discloses a portable track device for a wheelchair that includes at least two track sections, which can be coupled removably to each other, and each track section has a bottom channel between a right sidewall and a left sidewall, with a reinforcement rod in each sidewall and with transverse supports located in the bottom channel. Each track section is equal to, or greater than the length of the wheelchair. The occupant of the wheelchair can travel safely across difficult terrain, such as a sandy beach.

U.S. Pat. No. 5,446,937 to Haskins discloses a modular ramp system in which each section is sloped owing to its leg height. The elements may be arranged in various combinations in order to conform to thresholds having offsets of different heights.

A need still exists, however, for improved means of providing a ramp where there are disadvantages to the expensive and time-consuming construction of a permanent ramp.

SUMMARY OF THE INVENTION

It is an object of the present invention to provide a portable lightweight ramp which can be used to assist handicapped people at public or other buildings where the alteration of the building into a permanent accessible structure is not permitted or desirable due to economic, geometric, geographic or historical constraints. Such a ramp can have wide application, for example, at military and naval installations as a portable, convenient, expedient and inexpensive way to load and unload buildings and ships.

The ramp of the present invention includes a plurality of interconnecting panels. A first panel has a proximate end and a distal end. At the proximate end there is detachable means for connecting the first panel to a step, curb, threshold or other obstruction the ramp is to be used to provide access to. A second panel has a proximate and distal end and at the proximate end there is a detachable means for connecting the second panel to the distal end of said first panel. This modular ramp is adapted to be lightweight and portable.

Preferably, this portable ramp will have a rigid polyethylene skin, impregnated with a polymeric foam core. The ramp will consist of a main panel section, a male tongue and female slots with two slots and two holes on two sides. During assembly, there will be a main slot with two holes for interlocking. The slots will interlock with mating parts and be pinned securely. There will be added accessories such as handrails, support legs and end caps, all of which will be installed in the slots and pinned.

BRIEF DESCRIPTION OF THE DRAWINGS

Other objects, features and advantages of the present invention will become apparent upon reference to the following description of the preferred embodiments and to the drawing, wherein corresponding reference characters indicate corresponding parts in the drawing and wherein:

FIG. 9 is a distal end view of another preferred embodiment of a panel used in the ramp shown in FIG. 1;

FIG. 10 is a cross-section along the plane defined by 10—10 in FIG. 9;

FIG. 11 is a cross-section through 11—11 in FIG. 10;

DESCRIPTION OF THE PREFERRED EMBODIMENT

Figure 1:
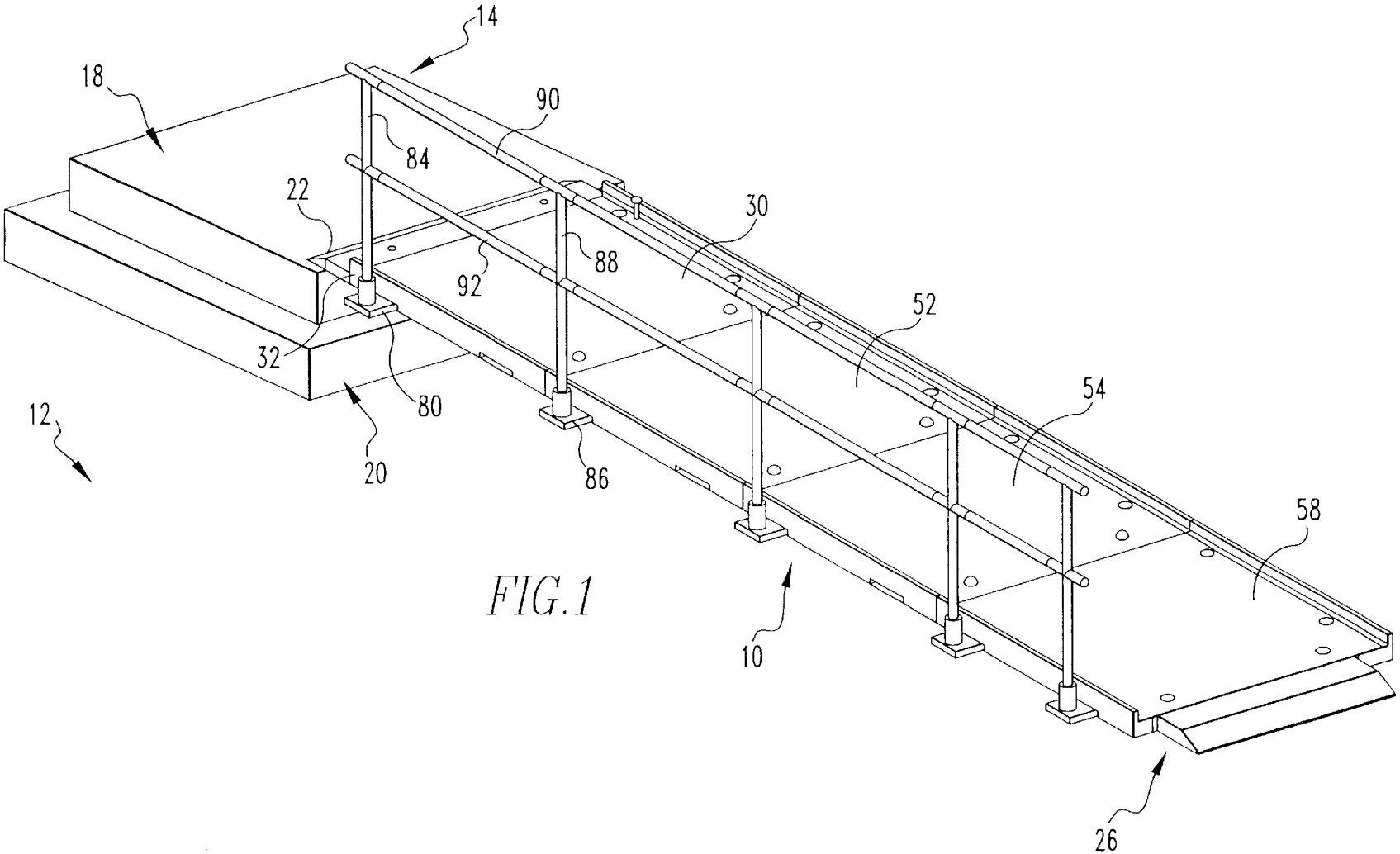
FIG. 1 is a front and side perspective view of a ramp representing a preferred embodiment of the present invention.

Referring to FIGS. 1–8, the ramp 10 rests on a base surface 12 and a step 14 having an upper surface 18. Ramp 10 extends from base surface 12 to upper surface 18 to provide a sloping surface between base surface 12 and upper surface 18. Adjacent a side 20 of the step 14 and attached to upper surface 18 of step 14, there is an end cap 22 in which a groove 24 is formed. There is also an end cap 26 with a tongue 28 on the opposed end of the ramp 10. Adjacent the side 20 there is a first proximate panel 30. There is a proximate side tongue 32 that engages groove 24 on the cap 22. Tongue 32 has apertures 34 and 36. There are aligned apertures 38 and 40 on the end cap 22 so as to allow the panel 30 to be fixed to the cap 22 by means of locking pins 42 and 44. In opposed relation to the tongue 32, there is on panel 30 a distal end groove 46, which is adapted in dimensions to receive a tongue such as tongue 32. Apertures 48 and 50 extend through the panels above and below the groove 46 to facilitate fastening of a mating tongue. The ramp also includes a second intermediate panel 52 adjacent to the first proximate panel 30 and a third intermediate panel 54 in distal relation to said second intermediate panel 52. On said third intermediate panel 54 there is a distal groove 56 and in distal relation thereto there is a distal panel 58 with a mating proximate side tongue 60. Locking pins 62 and 64 are used to secure this tongue 60 in the groove 56.

Figure 2:
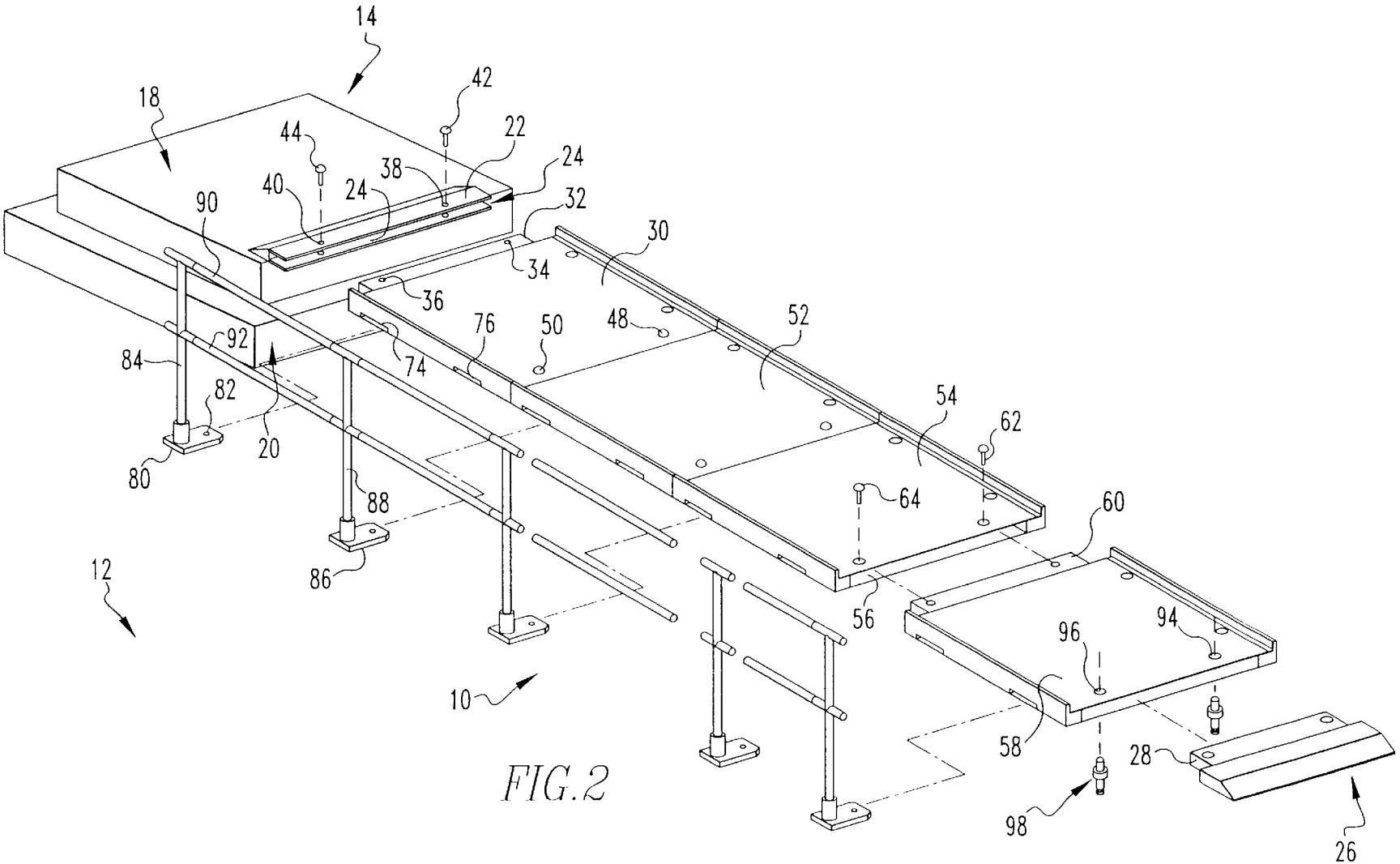
FIG. 2 is a front and side exploded perspective view of the ramp shown in FIG. 1.
Figure 4:
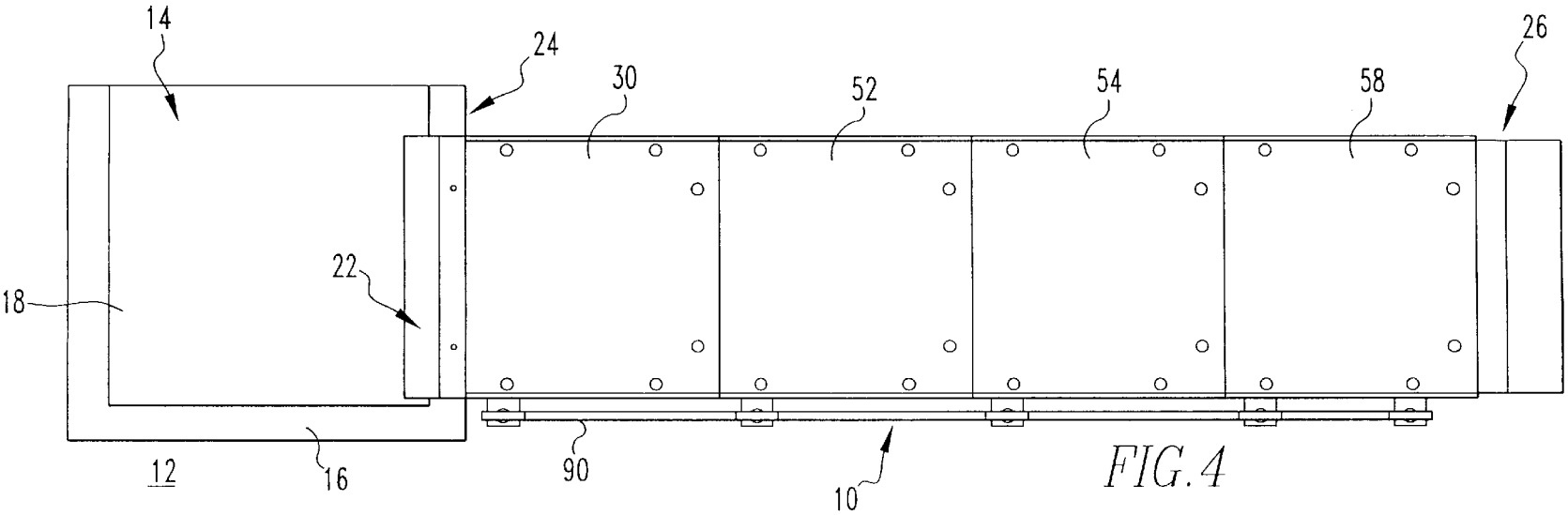
FIG. 4 is a top plan view of the ramp shown in FIG. 1.
Figure 3:
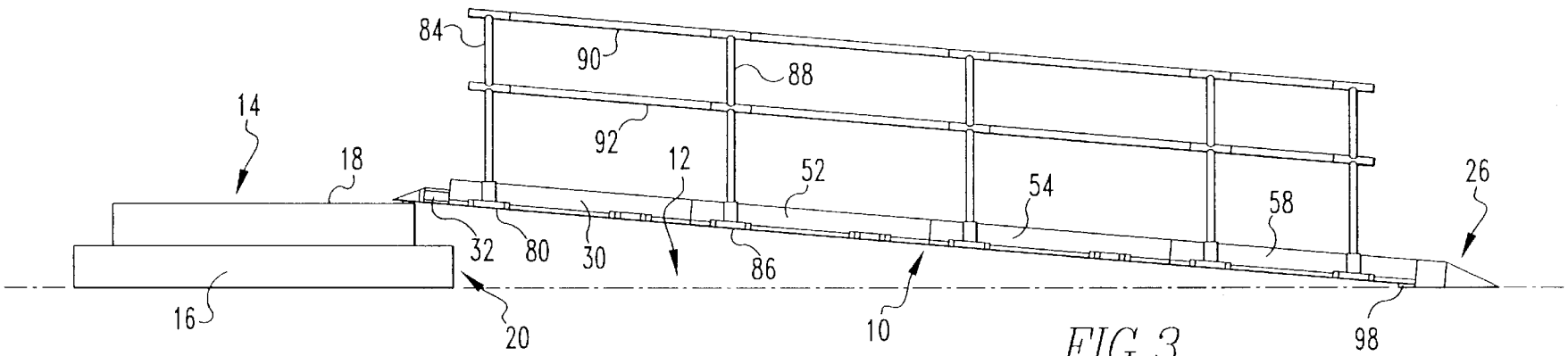
FIG. 3 is a side elevational view of the ramp shown in FIG. 1.
Figure 8:
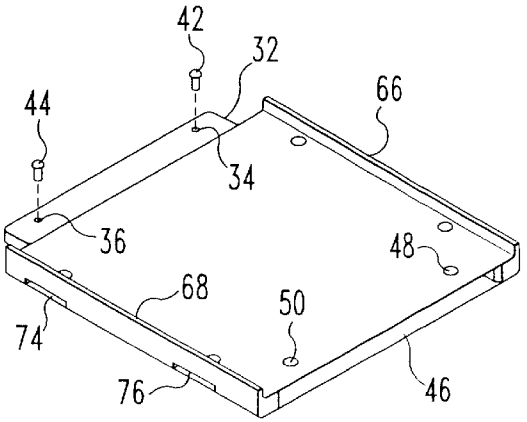
FIG. 8 is a distal end and side perspective view of the panel shown in FIG. 5.
Figure 5:
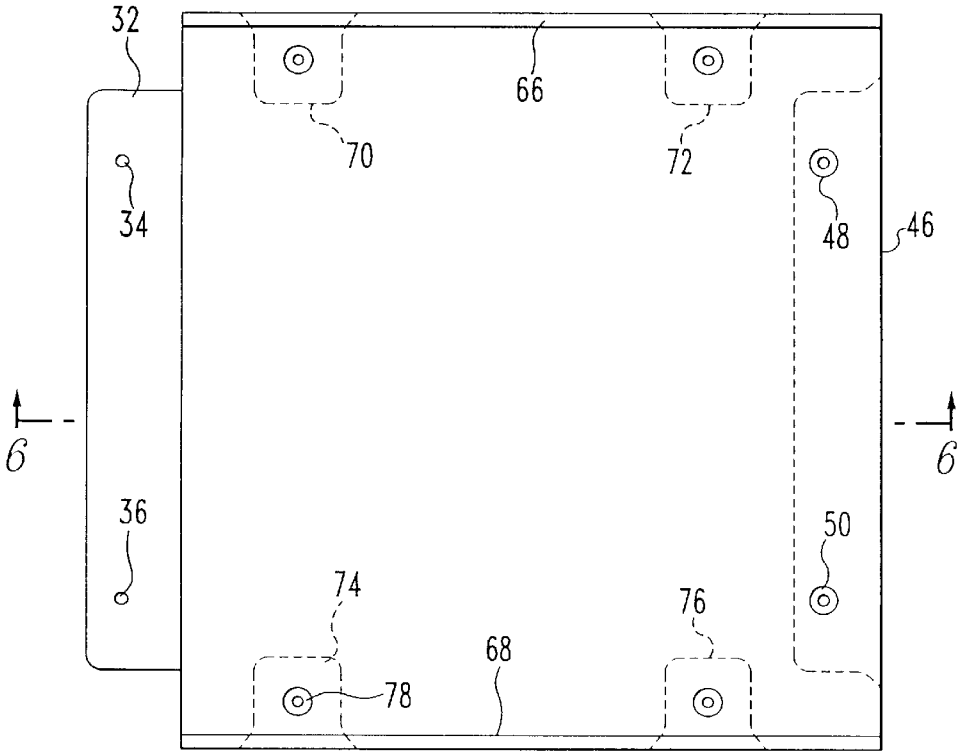
FIG. 5 is a top plan view of a panel used in the ramp used in FIG. 1.
Figure 6:
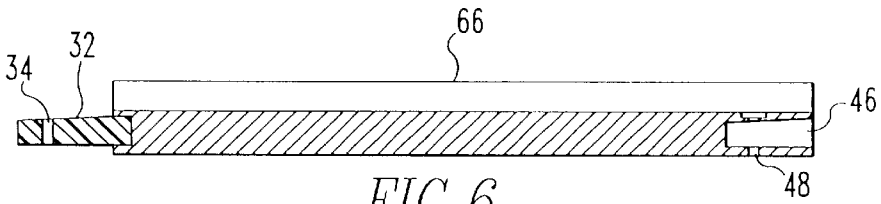
FIG. 6 is a cross-section through 6—6 in FIG. 5.
Figure 7:
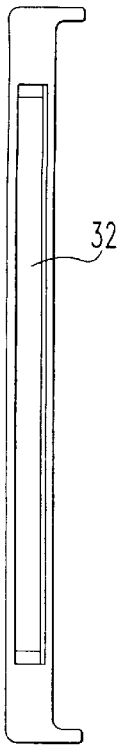
FIG. 7 is a proximate end view of the panel shown in FIG. 5.
Figure 13:
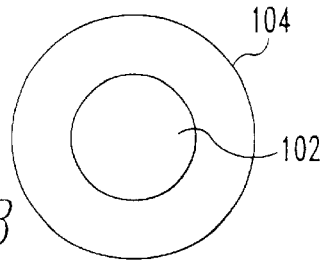
FIG. 13 is a top plan view of the support leg shown in FIG. 12.
Figure 12:
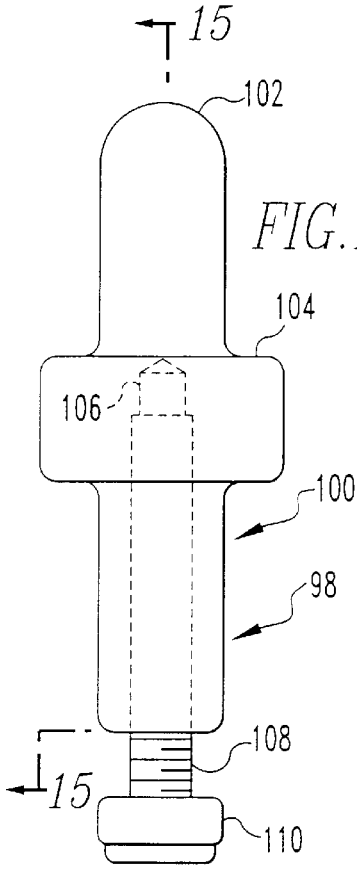
FIG. 12 is a side elevational view of a support leg used in the ramp shown in FIG. 1.
Figure 15:
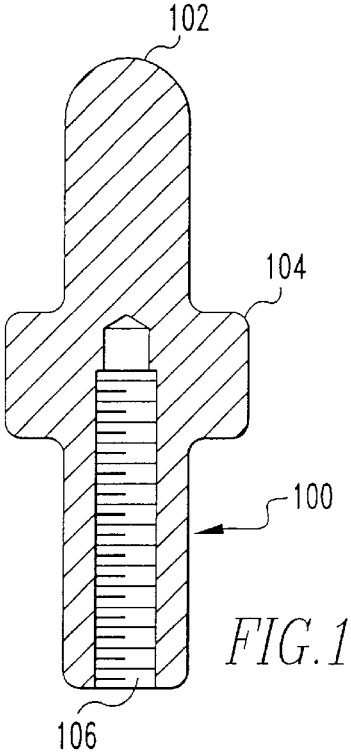
FIG. 15 is a cross-section through 15—15 in FIG. 12 (without the adjustment screw)
Figure 14:
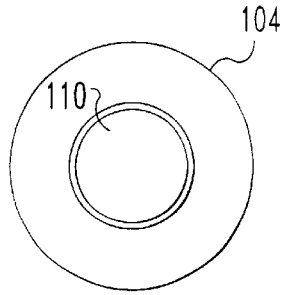
FIG. 14 is a bottom plan view of the support leg shown in FIG. 12.

It will be understood that all the panels used in the ramp are essentially identical. In panel 30, for example, there are opposed lateral sidewalls 66 and 68 in which there are side pockets 70, 72, 74 and 76. Each of these side pockets has in the panel above and below the pocket a side pocket aperture as in aperture 78 in side pocket 74. There is a plurality of rail bases as at rail base 80, which fit into the side pockets as at side pocket 74 in lateral side wall 66. Each of these bases has a rail base aperture as at aperture 82, which align with a side pocket aperture as at aperture 78 to allow the bases to be secured to the side pockets by lock pins 42*a*, one of which is shown in FIG. 2. The rail bases as at rail base 80 support vertical supports as at vertical support 84. Rail base 86, as a further example, supports vertical support 88. These vertical supports as at vertical support 84 and 88 cooperatively engage a plurality of upper lateral rails as at rail 90 and lower lateral rails as at rail 92 so as to provide lateral rail supports along at least one side of the ramp. At the distal end of the distal panel 58 there are support leg apertures 94 and 96, which engage support legs as at support leg 98 which is shown in FIGS. 12–14. Although not shown in the drawings, it will be understood that a similar rail may be positioned on the ramp on the opposed side of the ramp.

Referring particularly to FIGS. 12–14, the support leg 98 includes an outer housing 100, with an aperture engagement protrusion 102 and a panel support feature 104. The support leg 98 also includes a central cavity 106, which has a helical groove and receives adjustment screw 108. At the base of adjustment screw 108 there is a foot 110.

Figure 16:
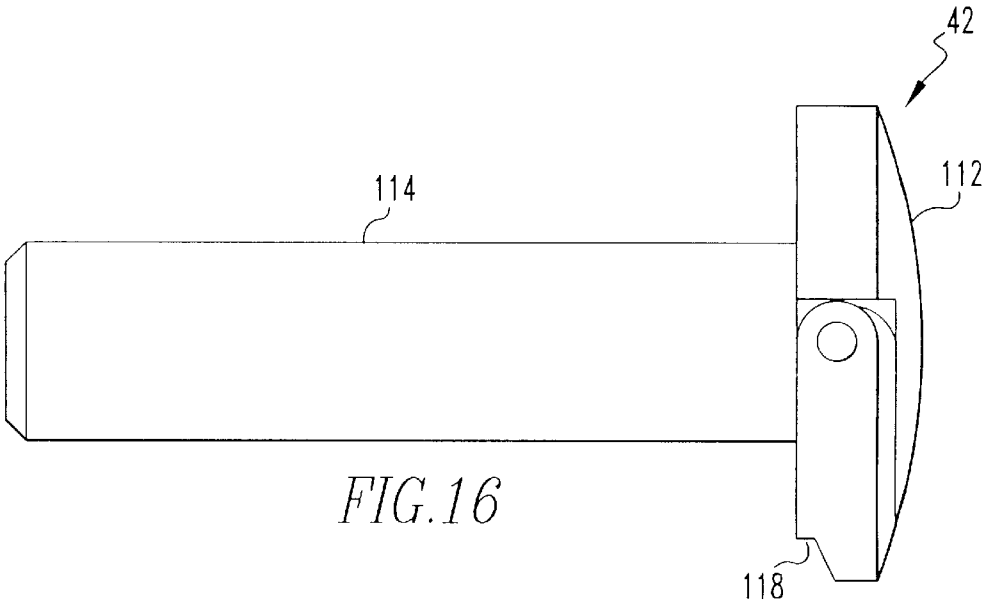
FIG. 16 is a side elevational view of a lock pin used in the ramp shown in FIG. 1.
Figure 17:
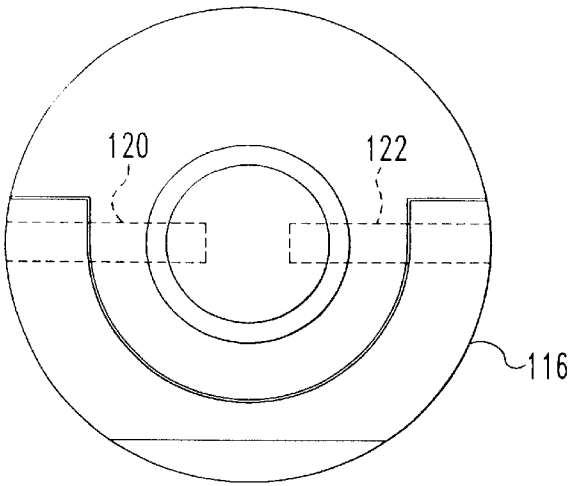
FIG. 17 is a bottom plan view of the lock pin shown in FIG. 16.

Referring to FIGS. 16–17, the lock pin 42 (and similarly for pins 42*a*, 44, 62 and 64) includes a head 112, a body 114 and a lock 116. There is a recess 118 beneath the lock 116 to facilitate upward and downward movement of the lock 116 on pins 120 and 122 to move the lock 116 from an upper unlocked to a lower locked position as shown. Preferably, movement of lock 116 to the locked position wedges lock pin 42 within aperture 34.

Referring to FIGS. 9–11, another preferred embodiment for a panel is shown. This panel has a rigid polyethylene top wall 124 and bottom wall 126. There is a proximate wall 128 with a proximate end tongue 130. There is a distal end wall 132 with a distal end groove 134. There are opposed lateral walls 136 and 138 that have lateral pockets as at pocket 140. As with the panel described above, attachments are by means of a plurality of apertures as at aperture 142 in pocket 140. There are also apertures as at aperture 144 in the proximate end tongue 130. There are also apertures as at aperture 146 adjacent the distal pocket 134. Inside the walls there is a polymeric foam-injected core 148.

Figure 18:
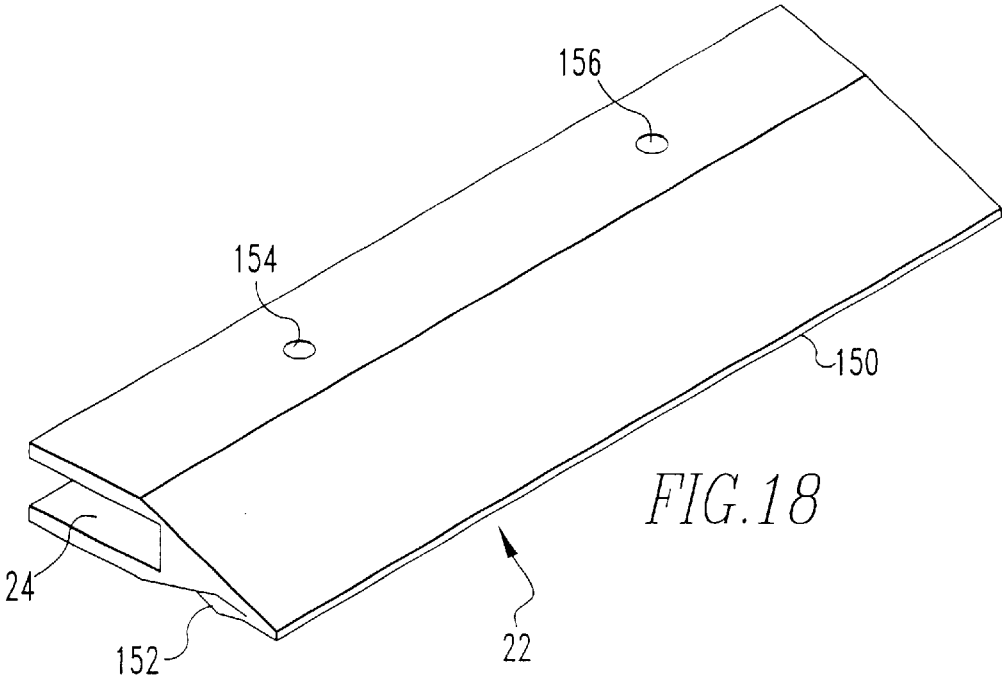
FIG. 18 is a front and end perspective view of one of the end cap elements of the ramp shown in FIG. 1.
Figure 19:
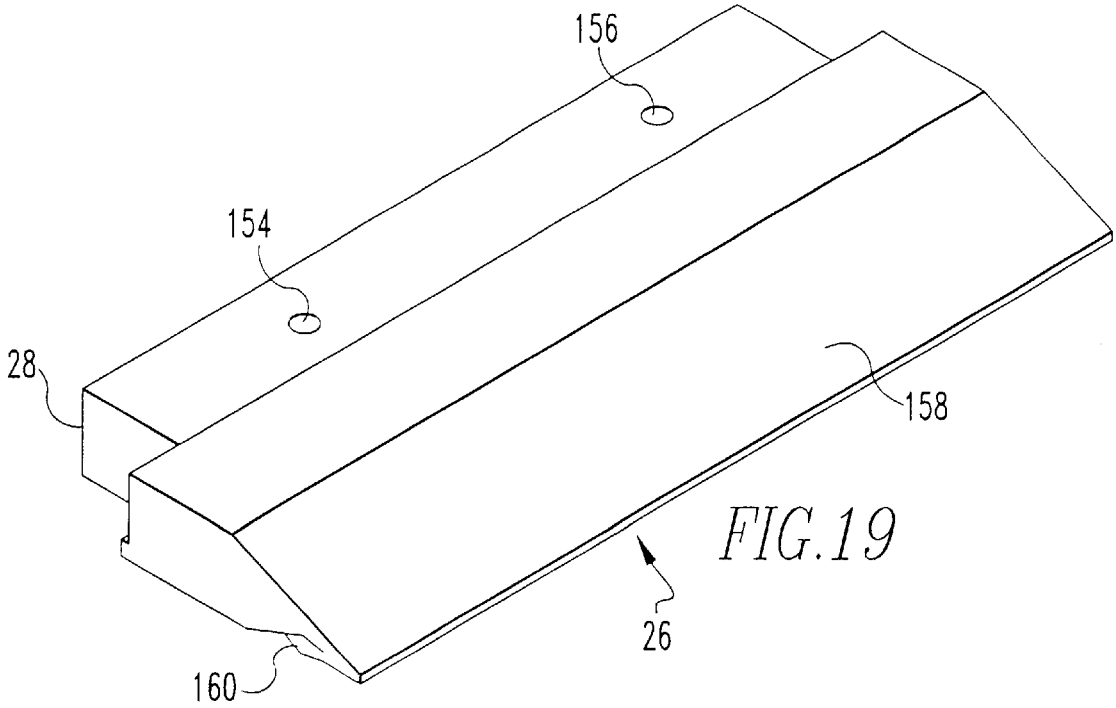
FIG. 19 is a front and end perspective view of the other one of the end cap elements of the ramp shown in FIG. 1.

Referring to FIGS. 18–19, further detail of the end caps 22 and 26 is shown. End cap 22 has an upper sloped front end 150 with a bottom non-skid surface 152. There are also vertical apertures 154 and 156 to allow end cap 22 to be secured to a panel with suitable fasteners. End cap 26 has an upper sloped front surface 158 and an opposed bottom non-skid surface 160. There are also vertical apertures 162 and 164 through tongue 28 to allow end cap 26 to be secured to a panel with suitable fasteners.

The advantages of this invention over permanent fixtures are that this ramp is flexible, lightweight and portable. This new design makes the ramp portable enough for an individual to carry and assemble in minutes. It eliminates the need to permanently deface a building of historical importance or to alter a building, which cannot be changed due to geometric or economic constraints.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A ramp assembly for interconnecting a base surface and an elevated surface, the assembly comprising:

a first end cap for mounting on the elevated surface and having an elongated concavity therein open in a direction facing the base surface;

a second end cap for mounting on the base surface and having an elongated tongue portion extending therefrom in a direction toward the elevated surface;

a first panel for connection to said first end cap, said first panel having a substantially planar upper surface for defining a first pathway, and first and second end surfaces for facing, respectively, said first end cap and said second end cap, said first end surface having an elongated tongue portion extending therefrom and configured complementarily to the first end cap concavity, and engageable in the first end cap concavity, said second end surface having an elongated concavity therein;

a second panel for connection to said second end cap, said second panel having a substantially planar upper surface for defining a second pathway for alignment with the first pathway, said second panel further having first and second end surfaces for facing, respectively, said first end cap and said second end cap, said second panel first end surface having an elongated tongue portion extending therefrom and configured complementarily to the first panel concavity and engageable in the first panel concavity, said second panel second end surface having an elongated concavity therein configured complementarily to the second end cap tongue portion and adapted to receive the second end cap tongue portion;

each of the concavities being formed by upper and lower walls having aligned apertures therein;

each of the tongue portions having holes therein alignable with the concavity wall apertures; and connectors each for extending through one of the concavity upper walls, through one of the tongue portion holes, and through one of the concavity lower walls, to secure the respective tongues in the respective concavities, to erect the ramp assembly;

wherein said first and second panels are provided with vertically adjustable support legs; and wherein the support legs each comprise at a lower end thereof a foot plate having an aperture therein, said panels are provided with side surfaces, and each of said panel side surfaces is provided with a slot for receiving one of said foot plates, each of said panels being provided with an aperture extending into one of the slots and alignable with one of the foot plate apertures, and locking pins adapted for insertion through aligned panel and foot plate apertures to releasably hold the foot plates in the panel slots.

2. A ramp assembly for interconnecting a base surface and an elevated surface, the assembly comprising:

a first end cap for mounting on the elevated surface and having an elongated concavity therein open in a direction facing the base surface;

a second end cap for mounting on the base surface and having an elongated tongue portion extending therefrom in a direction toward the elevated surface;

a first panel for connection to said first end cap, said first panel having a substantially planar upper surface for defining a first pathway, and first and second end surfaces for facing, respectively, said first end cap and said second end cap, said first end surface having an elongated tongue portion extending therefrom and configured complementarily to the first end cap concavity, and engageable in the first end cap concavity, said second end surface having an elongated concavity therein;

a second panel for connection to said second end cap, said second panel having a substantially planar upper surface for defining a second pathway for alignment with the first pathway, said second panel further having first and second end surfaces for facing, respectively, said first end cap and said second end cap, said second panel first end surface having an elongated tongue portion extending therefrom and configured complementarily to the first panel concavity and engageable in the first panel concavity, said second panel second end surface having an elongated concavity therein configured complementarily to the second end cap tongue portion and adapted to receive the second end cap tongue portion;

each of the concavities being formed by upper and lower walls having aligned apertures therein;

each of the tongue portions having holes therein alignable with the concavity wall apertures;

connectors each for extending through one of the concavity upper walls, through one of the tongue portion holes, and through one of the concavity lower walls, to secure the respective tongues in the respective concavities, to erect the ramp assembly; and an additional panel for connection to said first and second panels, said additional panel having a substantially planar upper surface for defining an additional pathway for alignment with the first and second pathways, said additional panel having first and second end surfaces, the additional panel first end surface having an elongated tongue portion extending therefrom and configured complementarily to the first panel concavity and engageable in the first panel concavity, the additional panel second end surface having an elongated concavity configured complementarily to the second panel tongue portion and adapted to receive the second panel tongue portion, the additional panel concavity being formed by upper and lower walls having aligned apertures therein alignable with the second panel tongue portion holes, and the additional panel tongue portion having holes therein alignable with the first panel concavity holes, such that said additional panel is adapted to be mounted between said first and second panels and connected thereto.

3. The assembly in accordance with claim 2 wherein each of said panels is provided with vertically adjustable support legs.

4. The assembly in accordance with claim 2 wherein said connectors comprise locking pins.

5. The assembly in accordance with claim 3 wherein the support legs each comprise at a lower end thereof a foot plate having an aperture therein, said panels are provided with side surfaces, and each of said panel side surfaces is provided with a slot for receiving one of said foot plates, each of said panels being provided with an aperture extending into one of the slots and alignable with one of the foot plate apertures, and locking pins adapted for insertion through aligned panel and foot plate apertures to releasably hold the foot plates in the panel slots.

* * * * *